US007066095B2

(12) United States Patent
Augsburg et al.

(10) Patent No.: US 7,066,095 B2
(45) Date of Patent: Jun. 27, 2006

(54) RAILWAY UNDERCARRIAGE WITH A RADIALLY ADJUSTABLE WHEEL AXLES

(76) Inventors: Frank Augsburg, Phillip-Zorn-Str. 25, 91522 Ansbach (DE); Uwe Schüller, Kochstr. 4, 90441 Nuremberg (DE)

( * ) Notice: Subject to any disclaimer, the term of this patent is extended or adjusted under 35 U.S.C. 154(b) by 0 days.

(21) Appl. No.: 10/381,520

(22) PCT Filed: Sep. 26, 2001

(86) PCT No.: PCT/EP01/11099

§ 371 (c)(1),
(2), (4) Date: Jan. 20, 2004

(87) PCT Pub. No.: WO02/26542

PCT Pub. Date: Apr. 4, 2002

(65) Prior Publication Data

US 2004/0112248 A1 Jun. 17, 2004

(51) Int. Cl.
*B61D 1/00* (2006.01)

(52) U.S. Cl. ..... 105/157.1

(58) Field of Classification Search ..... 105/157.1, 105/182.1, 218.1, 218.2
See application file for complete search history.

(56) References Cited

U.S. PATENT DOCUMENTS 4,742,779 A * 5/1988 Bevand ..... 105/167
5,131,332 A * 7/1992 Smith ..... 105/224.05
5,909,711 A * 6/1999 Vogel et al. ..... 105/168
6,035,788 A * 3/2000 Mau et al. ..... 105/218.1
6,230,631 B1 * 5/2001 Archilla Aldeanueva et al. ..... 105/218.1

* cited by examiner

*Primary Examiner*—S. Joseph Morano
*Assistant Examiner*—Robert J. McCarry, Jr.
(74) *Attorney, Agent, or Firm*—Howrey LLP.; David P. Owen; Jacobus C. Rasser

(57) ABSTRACT

A rail vehicle undercarriage comprises a load bearing implement 1 in the form of the bogie frame of a two-axle bogie, wherein the load bearing implement 1 is supported on two wheel pairs 4, 4; 4, 4 by means of spring elements 2. One respective steering rod 9 that extends in the running direction of the wheels is provided per wheel 4, wherein said steering rods are coupled to the wheel carrier 3 adjacent to the corresponding wheel 4 with one end and to the load bearing implement with their other end in coupling points 8, 10. The wheel pairs can be turned relative to the load bearing Implement. In order to achieve a turning movement of the wheel pairs towards a curve-radial adjustment which depends on the curve radius of the currently used track, the respective steering rods 9 are directly coupled to the load bearing implement 1 in coupling points 10. In addition, the coupling points 10 of the steering rods 9 of at least one wheel pair 4, 4 are, referred to the plane defined by the contact points 6 between the wheels 4 and the rails 7, situated above the coupling points 8 of the steering rods 9 on the corresponding wheel carrier 3 when the steering rods 9 point toward the central region between two wheel pairs in the running direction of the wheels.

17 Claims, 5 Drawing Sheets

RAILWAY UNDERCARRIAGE WITH A RADIALLY ADJUSTABLE WHEEL AXLES

BACKGROUND OF THE INVENTION

1. Field of the Invention

The invention pertains to a rail vehicle undercarriage according to the preamble of the first claim.

2. Description of the Related Art

A known rail vehicle undercarriage of this type (DE 37 25 574 A1) is realized in the form of a two-axle bogie. Both wheels of each wheel pair are arranged on a common wheel axle. The wheel bearing of each wheel is realized in a two-armed fashion and respectively carries two spring elements arranged symmetrically referred to the wheel axle and elastic in the longitudinal and the transverse direction. One respective arm of the bogie frame is respectively supported on two spring elements. The longitudinally and transversally elastic spring elements form the primary spring suspension, whereas secondary spring elements arranged on the bogie frame serve for supporting an assigned vehicle body. A steering rod is respectively coupled in a pivoted fashion to the individual wheel carriers in coupling points. In this case, the respective steering rods essentially extend toward the centre of the corresponding longitudinal beam of the bogie frame in the running direction of the wheels. These ends of the steering rods are coupled in a pivoted fashion to the opposite ends of a two-armed steering lever in coupling points. The two-armed steering lever is supported in a pivoted fashion in its centre point on an axle that extends transversally to the running direction of the wheels. The length of the steering rods is chosen such that the two-armed steering lever extends approximately vertical when driving on a straight track. With this arrangement it is intended to realize that, with a simple wheelset coupling controlled independently of the vehicle body, an automatic radial adjustment of the wheel axles in curves and, simultaneously, a superior stability at high speeds is achieved, and the longitudinal forces resulting from acceleration or deceleration manoeuvres are transmitted from the wheel pairs onto the undercarriage in a reactionless fashion.

A rail vehicle undercarriage with an arrangement for stabilizing the rail vehicle course at high speeds is also known from U.S. Pat. No. 4,510,871. In this undercarriage, the steering rods are directly coupled to the load bearing implement in order to realize the turning movements of the wheel pairs. The steering rods are arranged trapezoidally in the horizontal plane such that the axial displacement of the wheel pairs caused by the tracking forces while driving through a curve results in an adjustment that is directed opposite to the radial curve adjustment and intended to stabilize the rail vehicle.

BRIEF SUMMARY OF THE INVENTION

The invention, in contrast, is based on the objective of developing a rail vehicle undercarriage with two wheel pairs and a load bearing implement supported by means of at least one spring element on at least one of the two wheel pairs, the wheel pairs arranged to be turnable relative to the load bearing implement in such a way that a turning movement of the wheel pair(s) towards the curve-radial adjustment corresponding to the curve radius of the currently used track is achieved with simple means independently of steering forces that result from the wheel/rail geometry.

This objective is attained by the use steering rods extending approximately in the running direction of a respective wheel, one end of each steering rod connected to a corresponding wheel carrier adjacent to the respective wheel at a first coupling point and the other end of the respective steering rod coupled to the load bearing implement at a second coupling point. The second coupling points of the steering rods of at least one wheel pair are arranged, with respect to the plane defined by the contact points between the wheels and the rails, on the load bearing implement either above the first coupling points of the steering rods on the respective wheel carrier if the steering rods are situated within an intermediate space between the wheel pairs in the running direction of the wheels, or underneath the first coupling points of the steering rods on the respective wheel carrier if the steering rods are situated outside the intermediate space between the wheel pairs in the running direction of the wheels.

The design of the rail vehicle undercarriage in accordance with the invention makes use of the fact that, when driving a rail vehicle through a curve with excess centrifugal force, e.g., among others due to the fact that the vehicle body is inclined radially outward referred to the curve, the wheels on the outer side of the curve are subjected to a higher load than the wheels on the inner side of the curve. As a consequence, the corresponding load bearing implement is subjected to a higher load in the region of the wheels on the outer side of the curve than in the region of the wheels on the inner side of the curve. Thus, the spring elements between the load bearing implement and the wheel carrier(s) on the outer side of the curve are additionally compressed in their longitudinal direction such that the distance between the load bearing implement and the respective wheel carrier is reduced. However, the corresponding wheels on the inner side of the curve are alleviated from the load such that the vertical distance between the load bearing implement and the respective wheel carrier is increased on this side. Due to the defined incline of the steering rods and their direct coupling to the load bearing implement with one end and the respective wheel carrier with the other end, this change in distance causes the wheel carriers on the outer side of the curve and consequently the corresponding wheels to move apart from one another in opposite directions while the wheel carriers on the inner side of the curve and, consequently, the corresponding wheels move toward one another. This results in a pivoting or turning movement of the wheel pairs revolving about a common axis of rotation referred to a real yaw axis or a yaw axis that is defined by the respective spring elements. Since the axial distance between the wheels on the outer side of the curve is increased and the axial distance between the wheels on the inner side of the curve is reduced, an automatic turning movement of the wheel pairs towards the curve-radial adjustment takes place. Thus, a passive radial adjustment of the wheel sets of two-axle bogies with primary spring suspension or of rail vehicles with two single-axle, spring-suspended running gears or bogies is achieved. Thereby the steering rods may simultaneously transmit deceleration or acceleration forces between the wheel bearings and the corresponding vehicle body if the vehicle body is used as the load bearing implement. In any case, the steering rods of one wheel pair are inclined by the same angle of inclination relative to the plane of wheel/rail contact which is defined by the contact points between the wheels and the respective rails. A symmetric pivoting motion of the corresponding axles about their yaw axis then takes place under the different operating conditions.

BRIEF DESCRIPTION OF THE DRAWINGS

Other aspects of the invention are described in greater detail below with reference to embodiments that are schematically illustrated in the figures.

The figures show.

DESCRIPTION OF ILLUSTRATIVE EMBODIMENTS

Figure 1:
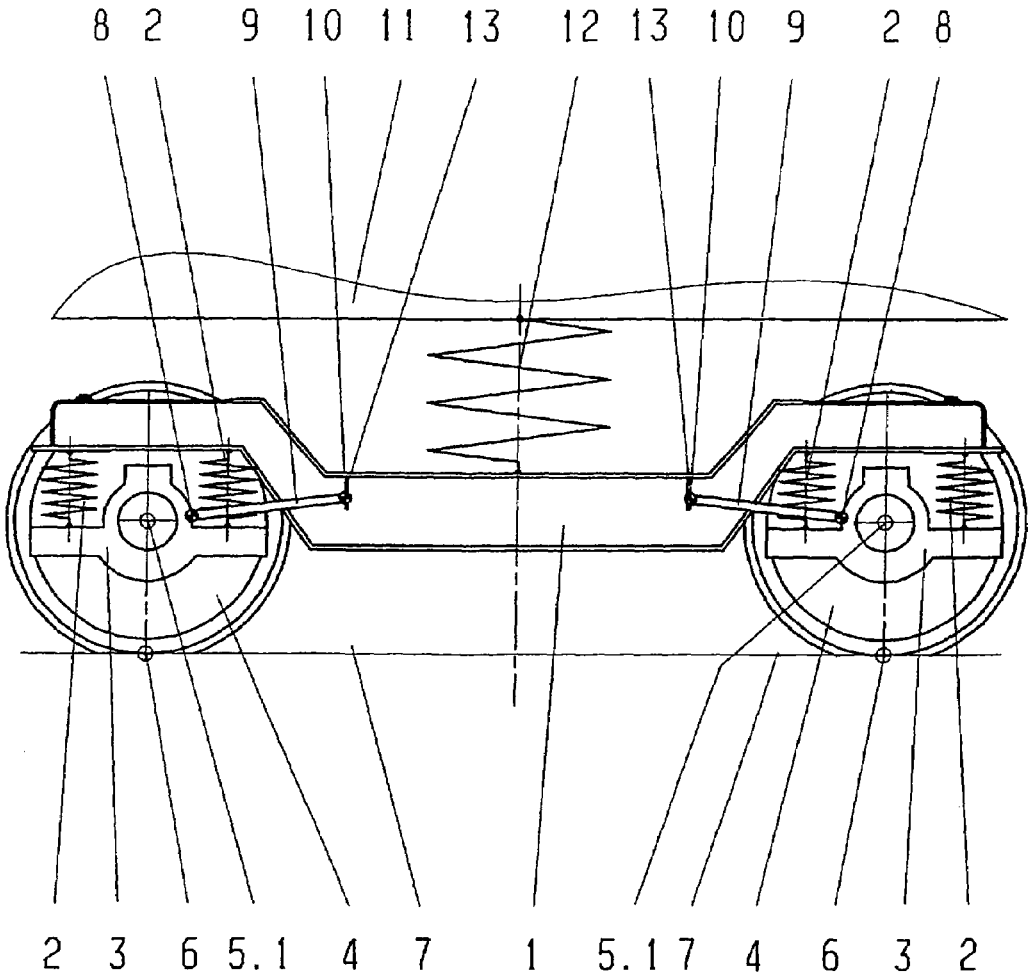
FIG. 1 a rail vehicle undercarriage in the form of a two-axle bogie with a vehicle body of a rail vehicle supported thereon.

According to FIG. 1, a two-axle bogie forms a rail vehicle undercarriage, wherein the longitudinal beams of a bogie frame 1 are angled on both ends and respectively supported on a two-armed wheel carrier 3 by means of two respective primary spring elements 2. In this case, one wheel 4 is respectively assigned to the four wheel carriers 3, wherein two equiaxially arranged wheels 4 respectively form one wheel pair with a common axle or shaft 5. Two wheels 4 that are arranged behind one another in the driving direction are in contact with one respective rail 7 of the currently used track in contact points 6. A steering rod 9 is coupled in a pivoted fashion to each wheel carrier 3 in a coupling point 8, while the other end of the steering rod is directly coupled in a pivoted fashion by means of a console 13 and via a coupling point 10 to the load bearing implement, in this case, to the bogie frame 1. The two wheels 4 assigned to an axle 5 may be arranged independently on the axle 5 in a free-wheeling fashion or may be rigidly coupled to the axle 5 and form a wheelset. The primary spring elements 2 are not only elastically movable in their vertically extending longitudinal direction for load transmission, but also in the transverse direction, i.e., parallel to the plane that includes the four contact points 6, such that the wheelsets are supported relative to the bogie frame 1 to be independently turnable about a virtual yaw axis. However, the wheelsets may also be supported on the bogie frame 1 to be pivotable about a real central yaw axis. The steering rods 9 protrude toward one another from the axles 5 and the corresponding wheel carriers 3, respectively, and, consequently, are coupled to the load bearing implement (bogie frame 1) in the coupling points 10 within the intermediate space between the wheel pairs. Referred to the plane including the contact points 6, the coupling point 10 on the bogie frame 1 is situated higher than the coupling points 8 of the steering rods 9 on the respective wheel carrier 3.

A vehicle body 11 of a rail vehicle is respectively supported in the region of the longitudinal beams of the bogie 1, namely in the lowered central section, by means of two adjacent secondary spring elements 12 spaced apart from one another transversally to the driving direction of the bogie.

When the load on the bogie frame changes, its vertical distance from the respective wheel carrier 3 and the plane defined by the contact points 6 changes due to the effect of the primary spring elements 2. Since the steering rods 9 are directly coupled to the bogie frame 1 in the coupling points 10, their vertical position also changes accordingly. This means that the vertical distance between the coupling points 10 and the aforementioned plane decreases while the vertical distance between the coupling points 8 and this plane remains unchanged when the load increases. Since the coupling points 10 move perpendicular to the plane of contact, the effective length of the steering rods increases in the normal projection on this plane and on the plane that includes the longitudinal centre lines of the axles 5, respectively, when their angle of inclination is reduced correspondingly, such that the respective coupling point 8 and consequently the assigned wheel carrier 3 and the wheel 4, respectively, are pushed away from the coupling point 10 in the driving direction. If the bogie frame 1 is alleviated from a load, the respective coupling point 10 moves upward from the plane of contact and the axial plane, respectively, such that the effective length of the respective steering rod 9 resulting from the horizontal projection is reduced and the coupling point 8 in question and consequently the wheel carrier 3 and the wheel 4, respectively, are pulled toward the corresponding coupling point 10. This means that only a parallel shift of the axles 5 which leads to an increase or decrease in the distance between the longitudinal centre lines of the axles 5 takes place when the bogie frame 1 is subjected to an even load. Since the vehicle body needs to be loaded in a largely symmetric fashion in accordance with applicable regulations, changes in the loading weight of the vehicle body 11 do not lead to a steering movement of the wheel pairs.

However, when the rail vehicle drives through a curve, the vehicle body 11, in particular, is inclined toward the outer side of the curve due to the occurring centrifugal forces such that the longitudinal beam of the bogie frame 1 on the outer side of the curve is subjected to an increased load while the load on the longitudinal beam on the inner side of the curve usually decreases. The increased load on the longitudinal beam of the bogie frame on the outer side of the curve caused by the centrifugal force leads to the wheel carriers 3 on the outer side of the curve to be pushed apart from one another such that the distance between the axles 5 is increased on the outer side of the curve. If the load on the longitudinal beam of the bogie frame on the inner side of the curve is alleviated, the distance between the wheel carriers 3 on the inner side of the curve is reduced correspondingly. Consequently, the axles 5 of the two wheel pairs 4, 4; 4, 4 are automatically turned towards a curve-radial adjustment by the centrifugal forces occurring while driving through a curve. This makes it possible to achieve a very low wheel flange wear, a corresponding reduction in the sound emission and low Y-forces between the wheel and the rail, i.e., transverse to the driving direction, with comparatively simple means. Since the maximum centrifugal acceleration on rail vehicles in curves is predetermined, an ideal radial adjustment of the wheel pairs can be achieved, in particular, for the most commonly used curve radius of a track by varying the stiffness of the primary springs and by choosing the length and the relative angle of the steering rods accordingly.

Figure 2:
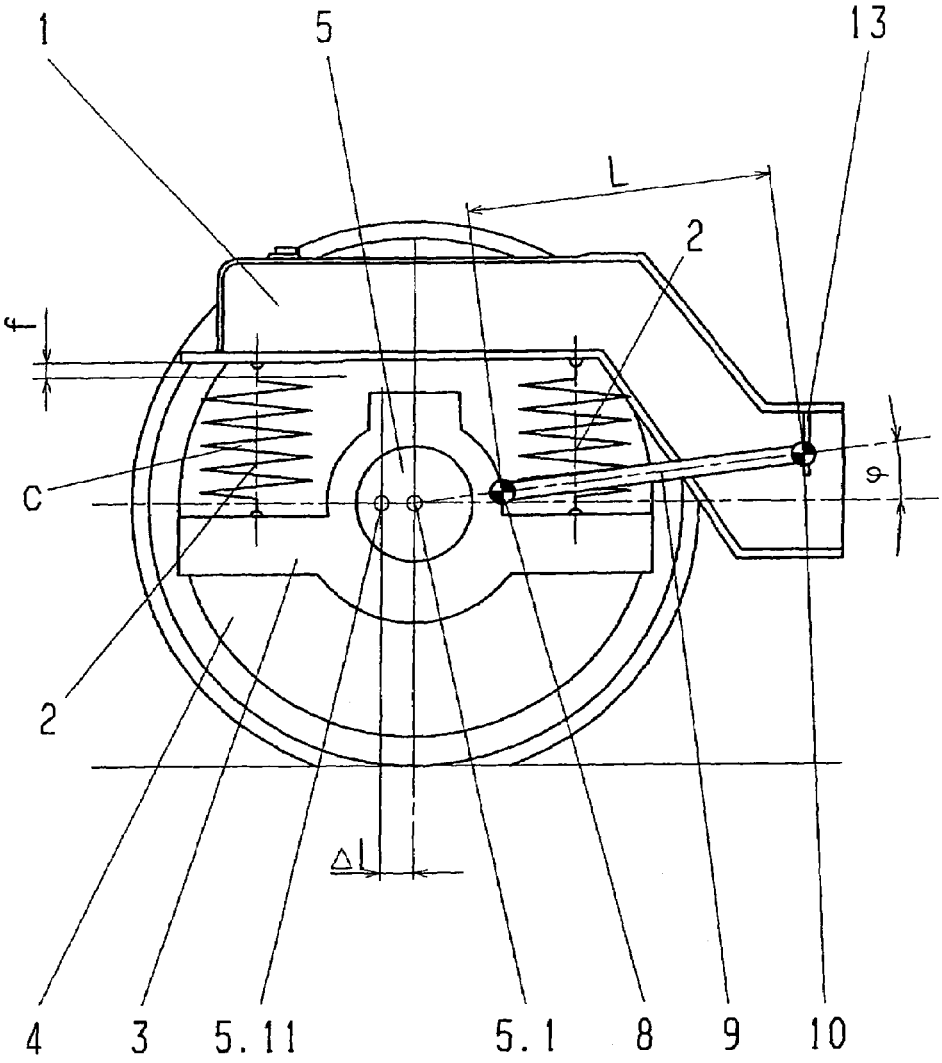
FIG. 2 an enlarged representation of a steering rod arrangement in the region of one wheel, wherein the dimensions of functional components are also indicated in this figure.

In the functional representation according to FIG. 2 which is illustrated not to scale, the coupling point 10 travels vertically downward by the distance f and, thus, reduces the angle of inclination ö of the steering rod 9 during a spring deflection of the bogie 1. This causes the coupling point 8 and consequently the centre point 5.1 of the shaft 5 to be pushed away from the coupling point 10 toward the left by the distance Ä1, namely into the position 5.11. Accordingly, the shaft 5 carries out a turning movement if the other wheel assigned to the shaft 5 is subjected to a lower load than the wheel 4 shown.

Figure 3:
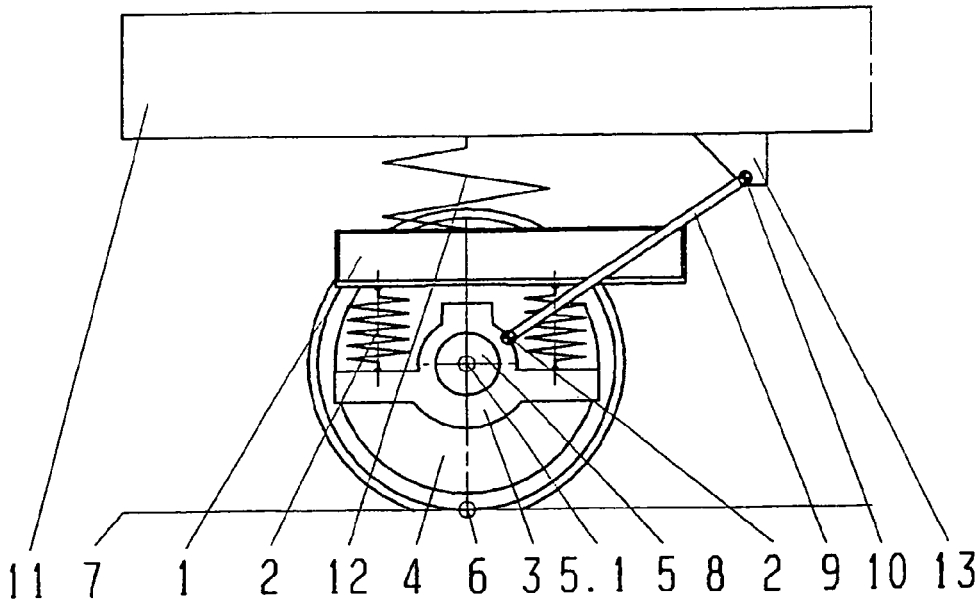
FIG. 3 a rail vehicle undercarriage in the form of a rail vehicle represented in half comprising two single-axle bogies and load bearing implement being formed by the vehicle body.

In the rail vehicle according to FIG. 3, the vehicle body 11 of a rail vehicle forms the load bearing implement that is supported on a bogie frame 1 of a single-axle bogie by means of secondary springs 12. Analogous to FIG. 1, the bogie frame 1 is supported on the respective wheel carrier 3 of the corresponding wheel 4 by means of two primary spring elements 2 that are illustrated in the form of coil springs. Here, passing the bogie frame 1, the steering rod 9 extends from the coupling point 8 on the wheel carrier 3 to the coupling point 10 on a console 13 arranged on the vehicle body 11. The coupling point 10 of the steering rod 9 which is assigned to the load bearing implement (vehicle body 11) also lies above the coupling point 8 on the wheel carrier 3 referred to the plane of contact of the wheels 4. The steering rods 9 that, in a top view, also extend in the running direction of the bogie are upwardly inclined toward the central section of the vehicle body 11 from the respective wheel carrier 3. Under the other not-shown part of the vehicle body 11 which lies on the right in the figure, there is situated another bogie under the respective part of the vehicle body 11 preferably in the form of a mirror-inverted arrangement. When the rail vehicle undercarriage with this design drives through a curve, the occurring centrifugal forces again cause the secondary spring 12 on the outer side of the curve and the corresponding primary springs 2 of the respective bogie to be subjected to a higher load than when driving on a straight track with the consequence that the lowering of the coupling point 10 occurring during this process causes the wheel carrier 3 and, consequently, the axle 5 on the outer side of the curve to be shifted toward the left and toward the next closest free end of the vehicle body 11 in the embodiment shown. During this process, the coupling point 10 on the inner side of the curve moves upward, i.e., away from the plane of contact of the wheels 4 causing the wheel carrier arranged on this side to be moved in the opposite direction, i.e., toward the centre of the vehicle body 11. This results in the desired turning movement of the axle 5 towards a radial adjustment referred to the curve in the track currently used. In this design, the steering rods 10 not only extend over the region of the primary spring elements, but also the region of the secondary spring elements such that the adjusting path for the steering rods is influenced by the spring travel of the primary and the secondary spring elements.

Figure 4:
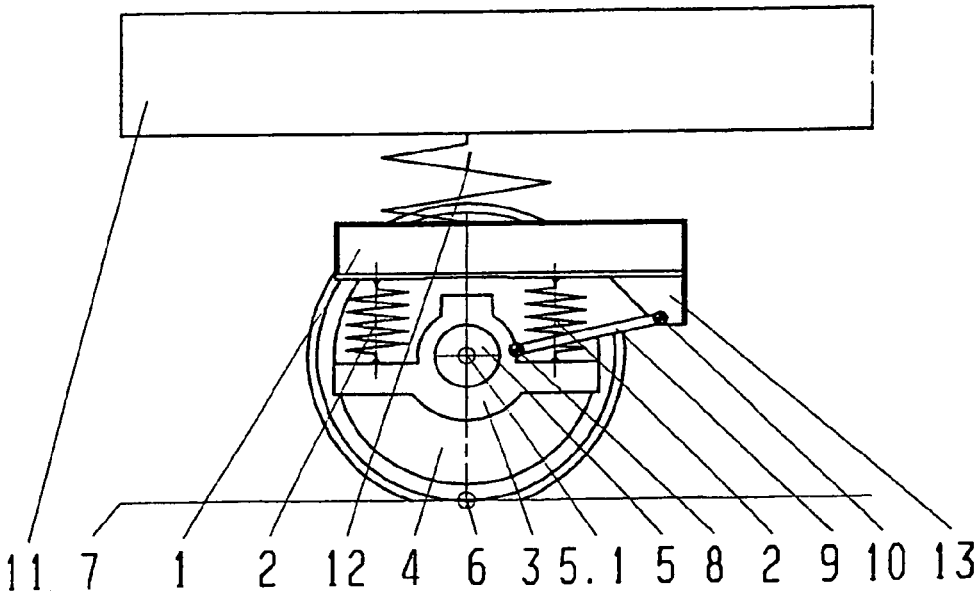
FIG. 4 a rail vehicle undercarriage in the form of one a rail vehicle represented in half comprising two single-axle bogies and a load bearing implement being formed by the bogie frame.

The arrangement according to FIG. 4 is essentially identical to that shown in FIG. 3, but the respective steering rods 9 are not coupled to the vehicle body 11, but to the bogie frame 1 that functions as the load bearing implement in this case. The steering rods 9 are also arranged in such a way that they extend upwardly from the coupling point 8 on the wheel carrier 3 to the additional coupling point 10, wherein the steering rods again point to the central part of the vehicle body 11. Here as well, a correspondingly designed bogie is preferably situated underneath the not-shown right section of the vehicle body 11 in the form of a mirror-inverted arrangement. The adjusting function of the steering rods 9 referred to the axle 5 is analogous to that described above with reference to FIGS. 1 and 2. Consequently, the shown wheel 4 on the outer side of the curve and its axle 5 are adjusted toward the next closest end of the respective vehicle body 1 shown at the left and, thus, towards the radial curve alignment when the section of the bogie 1 on the outer side of the curve is subjected to a load. On the not-shown single-axle bogie that is arranged on the right side in a mirror-inverted fashion, the wheel axle is accordingly adjusted toward the adjacent free end of the vehicle body on the right side and, thus, also towards the curve-radial adjustment of the corresponding axle under the same conditions.

Figure 5:
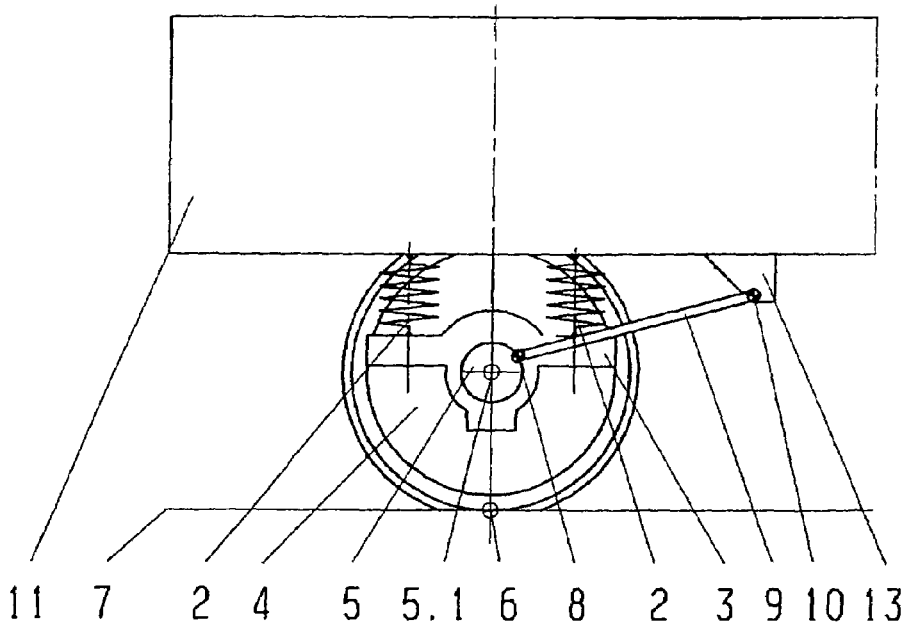
FIG. 5 a rail vehicle undercarriage in the form of a rail vehicle represented only in half, in which the vehicle body is directly supported on the wheel carriers of two single-axle running gears by means of spring elements, and in which the steering rods are arranged within the intermediate space between the wheel pairs.

According to FIG. 5, the rail vehicle undercarriage again comprises a vehicle body 11 that serves as the load bearing implement and is directly supported on two-armed wheel carriers 3 of a single-axle running gear by means of spring elements 2. The spring elements essentially correspond to the primary springs 2 described with reference to the preceding figures. The steering rods 9 extend upwardly from the coupling point 8 on the respective wheel carrier 3 to the additional coupling point 10 on the vehicle body 11 and point toward the central section of the vehicle box body 11. Another bogie, preferably of identical design but arranged mirror-invertedly, is situated under the vehicle body on the not-shown right end. In this case, the vertical movement of the coupling point 10 directly fixed to the vehicle body 11 is utilized for realizing the turning movement of the axle 5. This vertical movement results from the forces occurring on the vehicle body and the spring characteristics of the spring elements 2 that support the vehicle body 11.

Figure 6:
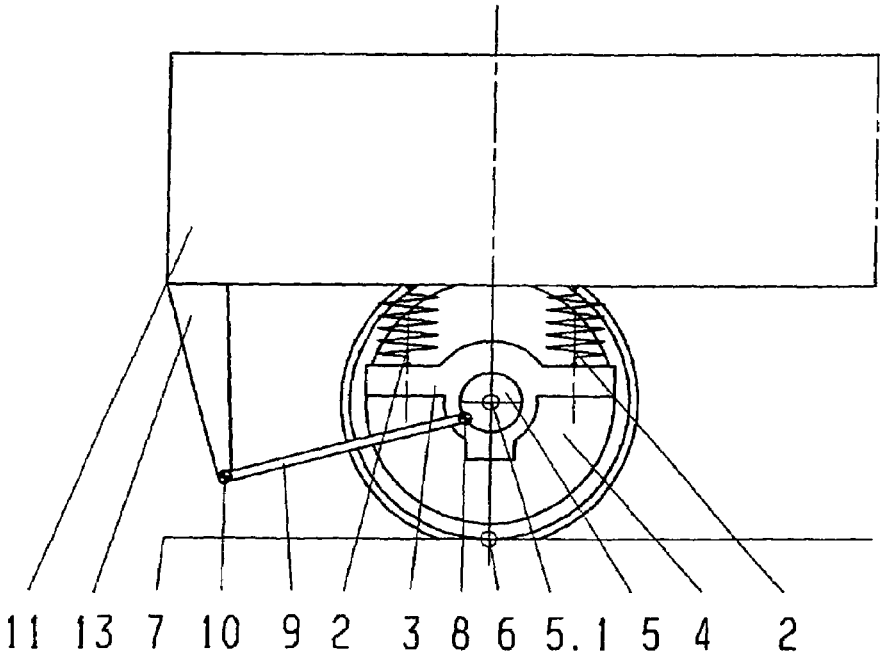
FIG. 6 a rail vehicle undercarriage in the form of a rail vehicle represented only in half, in which the vehicle body is directly supported on the wheel carriers of two single-axle running gears by means of spring elements, and in which the steering rods are arranged outside the intermediate space between the wheel pairs.

Again, in the arrangement shown in FIG. 6, a running gear according to FIG. 5 is arranged underneath the vehicle body 11 that serves as the load bearing implement. However, the steering rod 9 extends downward referred to the plane of wheel contact or the rail 7 from the coupling point 8 on the wheel carrier 3 and is held in the coupling point 10 at a sufficient vertical distance from the rail, the coupling point 10 being arranged on a downwardly directed console 13 that is rigidly connected to the vehicle body 11. In this arrangement, the length of the steering rod 9 on the outer side of the curve measured in the vertical projection is shortened when the vehicle body and consequently the support 13 are lowered on the outer side of the curve, since the inclination of the steering rod 9 caused by the downwardly displaced coupling point 10 is increased with the constant height of the coupling point 8 on the side of the wheel carrier. This subjects the end of the axle 5 which is situated on the outer side of the curve to the required turning movement in the direction toward the right end of the vehicle body 11 and consequently towards the curve-radial adjustment.

Figure 7:
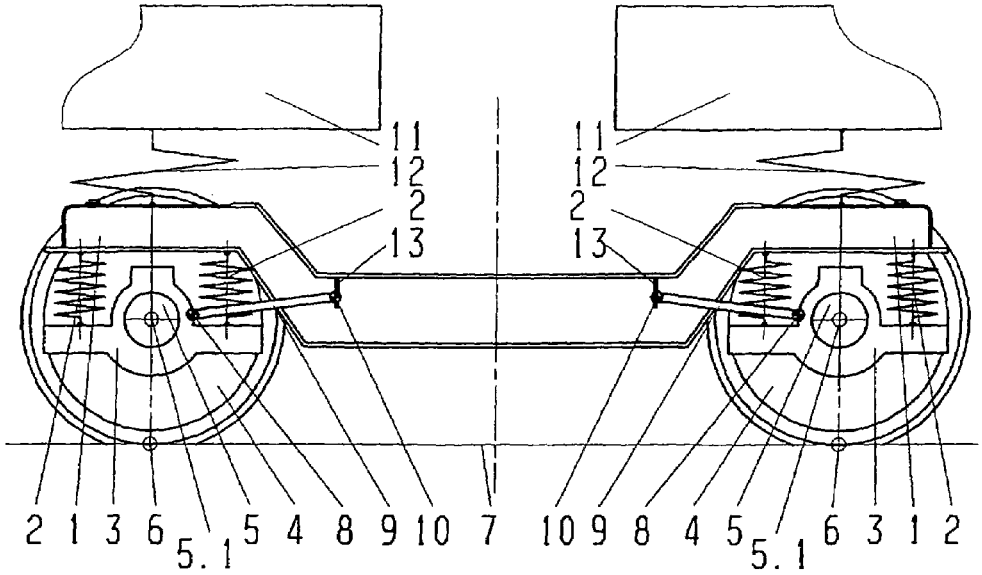
FIG. 7 a rail vehicle undercarriage with two separate vehicle bodies and a two-axle Jacobs bogie that supports the ends of these vehicle bodies, and FIG. 8 a top view of an enlarged detail in the region of a wheel with an assigned steering rod on a bogie.

In FIG. 7, a two-axle Jacobs bogie is used as the rail vehicle undercarriage according to FIG. 1 between the ends of two vehicle bodies 11. In this case, changes in the loads on both vehicle bodies to be supported largely affect the wheel pairs arranged underneath separately such that the turning movement of the respective wheel pair, in particular, in curve transitions, takes place in accordance with the respective section of the curve the corresponding vehicle body 11 is actually situated in. This results in a total steering angle on the axles 5 which is adapted to the average curve radius.

Figure 8:
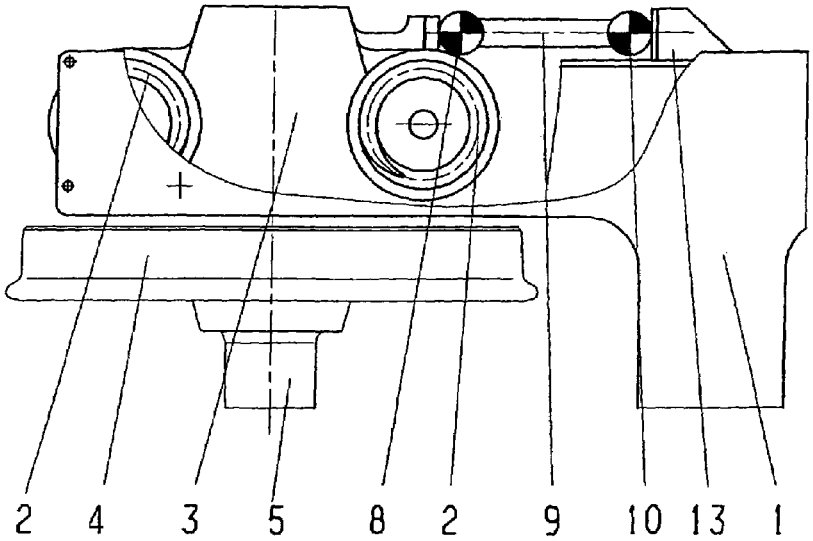

From FIG. 8 showing an enlarged detail of the region of a wheel 4 and the corresponding steering rod 9 it becomes apparent that, in a top view, the steering rod 9 is aligned parallel to the running direction of the wheel 4.

Although the arrangement according to the invention can be utilized with classical wheelsets, it is particularly suitable for use with free-wheeling wheelsets that do not generate any steering forces in curves due to the lack of a rigid axle connection between the two wheels. The length of the steering rods 9 may be variable in order to adjust a parallel alignment of the corresponding shafts 5 when a straight track is available. The steering rods 9 may be selectively provided with elastic or inelastic bearings in the coupling points 8 and/or 10. The utilization of at least one elastic rubber bearing is particularly advantageous with wheelsets, the wheels of which are fixed on a common shaft, namely because the forces resulting from the wheel/rail geometry can also be utilized for realizing the functionally appropriate turning movement. In addition, the angle of inclination of the steering rods 9 may be chosen differently depending on the desired steering angle of the axles 5 at a given inclination of the vehicle body 11. The angle of inclination may, for example, amount up to approximately 45 angular degrees, but preferably is chosen smaller than 20 degrees. In other respects, the angle of inclination of the steering rods 9 is, if so required, adjusted by means of height-adjustable coupling points 8 and/or 10, in particular, in such a way that the extensions of the imaginary central longitudinal axes of the steering rods 9 respectively intersect the imaginary central longitudinal axis of the corresponding wheel axle when the axles 5 are aligned parallel to one another.

What is claimed is:

1. A rail vehicle undercarriage with at least one load bearing implement that is supported by means of at least one spring element on at least one of two associated wheel pairs that are arranged behind one another in the running direction, and with one steering rod per wheel which extends approximately in the running direction of the respective wheel, one end of each respective steering rod being connected to a corresponding wheel carrier at a coupling point adjacent to the wheel and the other end of each respective steering rod being coupled to the load bearing implement, the wheel pairs being turnable relative to the load bearing implement, wherein the respective steering rods are directly coupled to the load bearing implement at coupling points, which are either a) above the coupling points of the steering rods on the respective wheel carrier if the steering rods are situated within an intermediate space between the associated wheel pairs in the running direction of the wheels or b) underneath the coupling points of the steering rods on the respective wheel carrier if the steering rods are situated outside the intermediate space between the associated wheel pairs in the running direction of the wheels, in order to achieve centrifugal force induced, automatic, curve radial adjustment of the wheel pairs on negotiating curves.

2. The rail vehicle undercarriage according to claim 1, wherein the load bearing implement consists of a bogie frame of a two-axle bogie that is supported on the wheel carrier of each wheel by means of two longitudinally and transversally elastic primary spring elements arranged symmetrically in relation to the axle of the corresponding wheels, wherein at least one vehicle body of a rail vehicle is supported on said bogie by means of at least one secondary spring element.

3. The rail vehicle undercarriage according to claim 1, wherein two load bearing implements are provided, each consisting of a singe-axle bogie that is respectively supported on the wheel carder of each wheel by means of two longitudinally and transversally elastic primary spring elements arranged symmetrically in relation to the axle of the two corresponding wheels, and wherein at least one vehicle body of a rail vehicle is supported on the bogie by means of at least one secondary spring element.

4. The rail vehicle undercarriage according to claim 1, wherein the respective wheel pair forms part of a single-axle running gear, on which a vehicle body of a rail vehicle forming the load bearing implement is supported by means of two respective longitudinally and transversally elastic spring elements arranged symmetrically in relation to the axle of the two corresponding wheels.

5. The rail vehicle undercarriage according to claim 1, wherein the load bearing implement consists of a vehicle body supported on the bogie frame by means of secondary spring elements, the bogie frame being supported on the wheel carriers by means of primary spring elements.

6. The rail vehicle undercarriage according to claim 1, wherein the steering rods are inclined relative to the plane defined by the contact points of the wheels by the same angle of inclination.

7. The rail vehicle undercarriage according to claim 6, characterized in that the angle of inclination is less than approximately 45 angular degrees.

8. The rail vehicle undercarriage according to claim 1, wherein, with the axles of both wheel pairs aligned in parallel to one another, the extensions of the imaginary central axes of the steering rods intersect the imaginary center axis of the corresponding wheel axle.

9. A rail vehicle comprising:

an undercarriage comprising:

a load bearing implement;

a first wheel pair comprising two wheels, each wheel having a wheel carrier movably connected to the load bearing implement so that the first wheel pair can pivot relative to the load bearing implement;

two first steering rods extending approximately in the running direction of the wheels, each first steering rod having a first end connected to a corresponding wheel carrier adjacent to the respective wheel at a first coupling point and a second end coupled to the load bearing implement at a second coupling point so that the position of the second end is fixed in relation to the load bearing implement;

a second wheel pair arranged behind the first wheel pair in a running direction and comprising two wheels, each wheel having a wheel carrier movably connected to the load bearing implement so that the second wheel pair can pivot relative to the load bearing implement; and two second steering rods extending approximately in the running direction of the wheels, each second steering rod having a first end connected to a corresponding wheel carrier adjacent to the respective wheel at a first coupling point and a second end coupled to the load bearing implement at a second coupling point so that the position of the second end is fixed in relation to the load bearing implement;

wherein the higher of the first and second coupling points of both the first and the second steering rods is located nearest a central point located between the first and second wheel pairs.

10. The rail vehicle according to claim 9, wherein the load bearing implement comprises a bogie frame of a two-axle bogie, the bogie frame supported on the wheel carrier of each wheel by means of two longitudinally and transversally elastic primary spring elements.

11. The rail vehicle according to claim 9, wherein two load bearing implements are provided, each comprising a single-axle bogie that is respectively supported on the wheel carrier of each wheel by means of two longitudinally and transversally elastic primary spring elements.

12. The rail vehicle according to claim 9, wherein each wheel pair forms part of a single-axle running gear, on which a vehicle body of a rail vehicle forming the load bearing implement is supported by means of two respective longitudinally and transversally elastic spring elements.

13. The rail vehicle according to claim 9, wherein the load bearing implement comprises a vehicle body supported on a bogie frame by means of secondary spring elements, the bogie frame being supported on the wheel carriers by means of primary spring elements.

14. The rail vehicle according to claim 9, wherein the steering rods are inclined relative to the plane defined byte contact points of the wheels by the same angle of inclination.

15. The rail vehicle according to claim 14, wherein the angle of inclination is less than approximately 45 angular degrees.

16. The rail vehicle according to claim 14, wherein the angle of inclination is less than 20 angular degrees.

17. The rail vehicle according to claim 9, wherein the extensions of the imaginary central axes of the steering rods intersect the imaginary center axis of the corresponding wheel axle when the axles of both wheel pairs are aligned parallel to one another.

* * * * *